US012225987B2

(12) United States Patent
Farber et al.

(10) Patent No.: US 12,225,987 B2
(45) Date of Patent: Feb. 18, 2025

(54) JEWELRY WITH RETRACTABLE MEMBER

(71) Applicant: TRIFOLD CREATIONS, LLC, Livingston, NJ (US)

(72) Inventors: Barry Farber, Livingston, NJ (US); Roland Krainz, Brooklyn, NY (US)

( * ) Notice: Subject to any disclaimer, the term of this patent is extended or adjusted under 35 U.S.C. 154(b) by 0 days.

(21) Appl. No.: 18/319,887

(22) Filed: May 18, 2023

(65) Prior Publication Data

US 2023/0404225 A1 Dec. 21, 2023

Related U.S. Application Data

(60) Provisional application No. 63/473,323, filed on May 18, 2022.

(51) Int. Cl.
*A44C 25/00* (2006.01)
*B43K 29/00* (2006.01)

(52) U.S. Cl.
CPC ..... *A44C 25/002* (2013.01)

(58) Field of Classification Search
CPC ..... B43K 29/00; B43K 21/006; B43K 8/003; B43K 7/005; B43K 5/005; B43K 5/16; A44C 25/002; A44C 15/003
USPC ..... 401/6, 88; 7/167, 168; 63/1.12
See application file for complete search history.

(56) References Cited

U.S. PATENT DOCUMENTS

| | | | | |
|---|---|---|---|---|
| 4,508,464 | A * | 4/1985 | Money | B43K 5/005 401/209 |
| 4,568,213 | A * | 2/1986 | Money | B43K 29/00 401/209 |
| 5,988,918 | A | 11/1999 | Johnson | |
| 9,186,929 | B1 * | 11/2015 | Mock | B43K 8/003 |
| 2010/0034575 | A1 * | 2/2010 | Colman | B43K 29/00 401/131 |
| 2011/0291999 | A1 * | 12/2011 | Liang | B43K 23/06 345/179 |
| 2016/0339736 | A1 * | 11/2016 | Li | B43K 24/023 |

* cited by examiner

*Primary Examiner* — Jack W Lavinder
(74) *Attorney, Agent, or Firm* — FisherBroyles, LLP; Susan M. Oiler

(57) ABSTRACT

Jewelry apparatus have a front planar body and a back planar body hingedly attached to one another by a transverse hinge, a retractable member secured to one of the planar bodies, and a cam in the transverse hinge in operative engagement with the retractable member and incorporated to rotate when either the front planar body or the back planar body rotates to an open position, thereby pushing the retractable member into a protruding position. Each planar body has a central spine, a first leaf, and a second leaf opposite the first leaf that are each hingedly attached to the central spine by a hinge oriented in a lengthwise direction (perpendicular to the transverse hinge). The lengthwise hinges can be spring hinges that automatically bias the first leaf and second leaf into an elongate position after the front planar body is folded along the transverse hinge to an open position.

17 Claims, 10 Drawing Sheets

JEWELRY WITH RETRACTABLE MEMBER

RELATED APPLICATIONS

This application claims the benefit of U.S. Application No. 63/473,323, filed May 18, 2022, the entirety of which is incorporated herein by reference.

TECHNICAL FIELD

The present invention relates generally to jewelry or writing instruments, more particularly the combination thereof that can be folded and stored in a substantially flat configuration resembling a pendent, trinket, charm, money clip, etc.

BACKGROUND OF THE INVENTION

Conventionally, writing instruments, such as pens, pencils and the like, are formed in an elongated cylindrical configuration. However, in many instances, it is not convenient to carry such writing instruments. U.S. Pat. No. 5,988,918 describes a pen that can be carried flat in a wallet or the like and then converted into the general configuration of a conventional writing instrument. This pen requires the user to fold the pen and hold it or secure it with a locking mechanism in the writing position. The pen tip is always in the writing position, so when folded, it must be secured in a tip holder. If the pen tip slips out of the tip holder, the pen could leave ink marks inside a purse or carrying bag, pocket, etc.

There is a need for an improved pen having a configuration that is more durable, can activate the pen tip when opening, and is considered jewelry. The same can also include spring hinges to automatically change to the writing position once open.

SUMMARY OF THE INVENTION

In one aspect, jewelry writing instruments are disclosed that have a front planar body and a back planar body hingedly attached to one another by a transverse hinge, a writing member secured to one of the front planar body or the back planar body in operative engagement with a first spring, and a cam incorporated in the transverse hinge at a position in operative engagement with the writing instrument and incorporated to rotate when either the front planar body or the back planar body is rotated to an open position, thereby pushing the writing member into a protruding position. Each of the front planar body and the back planar body have a central spine having a first leaf and a second leaf opposite thereto that are each hingedly attached to the central spine by a first hinge and a second hinge, respectively, that are oriented in a lengthwise direction (perpendicular to the transverse hinge). From a closed position to an open position, the front planar body is foldable along the transverse hinge and then the first and second leaves are foldable along the first hinge and the second hinge, respectively, inward in a direct toward the central spine into a writing position.

Each of the first and second hinges of the front planar body has a plurality of alternating knuckles defining a hollow barrel, which optionally each have seated therein and affixed thereto a spring that exerts a biasing force urging the respective first leaf and second leaf towards one another into the writing position.

In all embodiments, the transverse hinge can define a line of symmetry for the perimeter shape of the flat folding writing instrument in the open position. Either or both of the first planar body and the second planar body comprise one or more jewelry sets therein, which can each hold a synthetic or a natural gemstone. One example synthetic stone is cut glass. Any known natural gemstones used for jewelry making can be used herein.

In one embodiment, the writing member is an ink pen cartridge.

In all embodiments, the jewelry writing instrument can include a head removably attached to the transverse hinge. The head includes an attachment member selected from the group consisting of a money clip, a bail, a pocket clip, a hang tag, a hook, and combinations thereof. The head has a pair of opposing, user activatable, spring activated hooks that seat in receptacles in the transverse hinge.

In another aspect, jewelry apparatus are disclosed that have a front planar body and a back planar body hingedly attached to one another by a transverse hinge, a retractable member secured to one of the front planar body or the back planar body, and a cam incorporated in the transverse hinge at a position in operative engagement with the retractable member and incorporated to rotate when either the front planar body or the back planar body is rotated to an open position, thereby pushing the retractable member into a protruding position. Each of the front planar body and the back planar body comprise a central spine having a first leaf and a second leaf opposite thereto that are each hingedly attached to the central spine. The first and second leaves can be hingedly attached by a first spring hinge and a second spring hinge, respectively, that are oriented in a lengthwise direction (perpendicular to the transverse hinge). Each of the first spring hinge and the second spring hinge, when present, have a spring that automatically biases the respective first leaf and the second leaf into an elongate position toward the central spine after the front planar body is folded along the transverse hinge to an open position. Each spring can be a flat spring, and each of the first spring hinge and the second spring hinge can be a piano hinge having the flat spring fixedly connected thereto.

Each embodiment can include an activation spring seated in operative engagement with the retractable member. In one embodiment, the retractable member can be a writing instrument.

In all embodiments, either or both of the first planar body and the second planar body can include one or more jewelry set gemstones therein.

The invention will be described in detain hereinbelow in connection with use of a ball point pen refill as the writing member, by way of example. Any other writing implement, such as a pencil, an automatic-feeding pencil, other types of pens (such as a felt tip or other tip pens) may be used, as desired. The description in connection with a ball point pen should not be considered to be limiting of the invention for use only with a ball point pen, as should be apparent.

The above and other objects, features and advantages of the present invention will become readily apparent from the following detailed description which is to be read in connection with the accompanying drawings.

DETAILED DESCRIPTION

Figure 1:
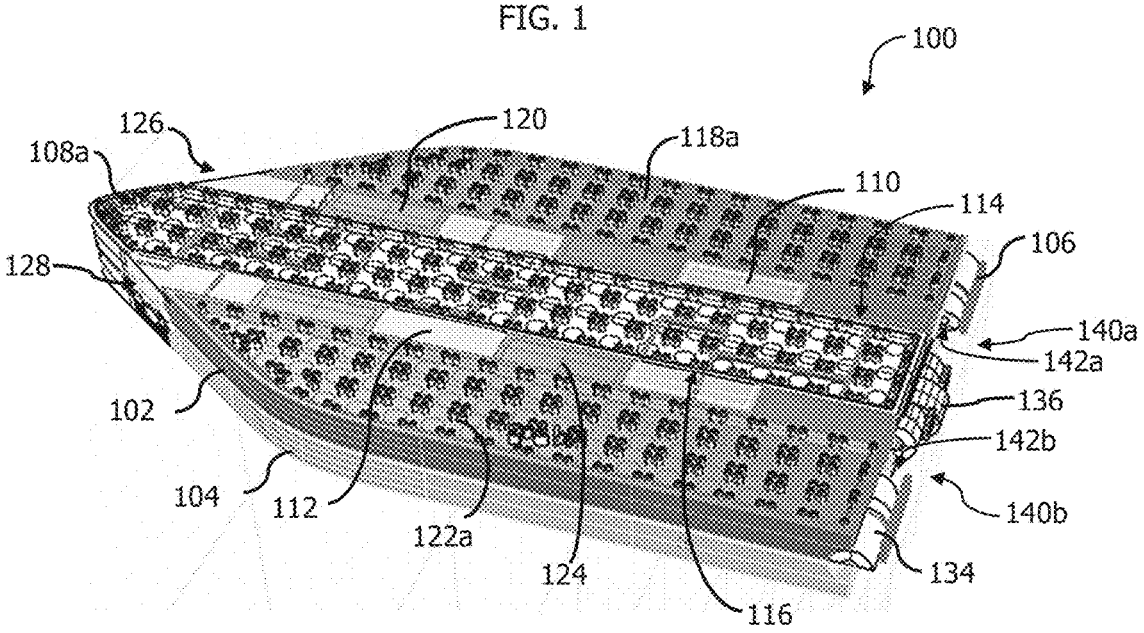
FIG. 1 is a perspective front view of a jewelry writing instrument, in its folded, closed position.
Figure 2:
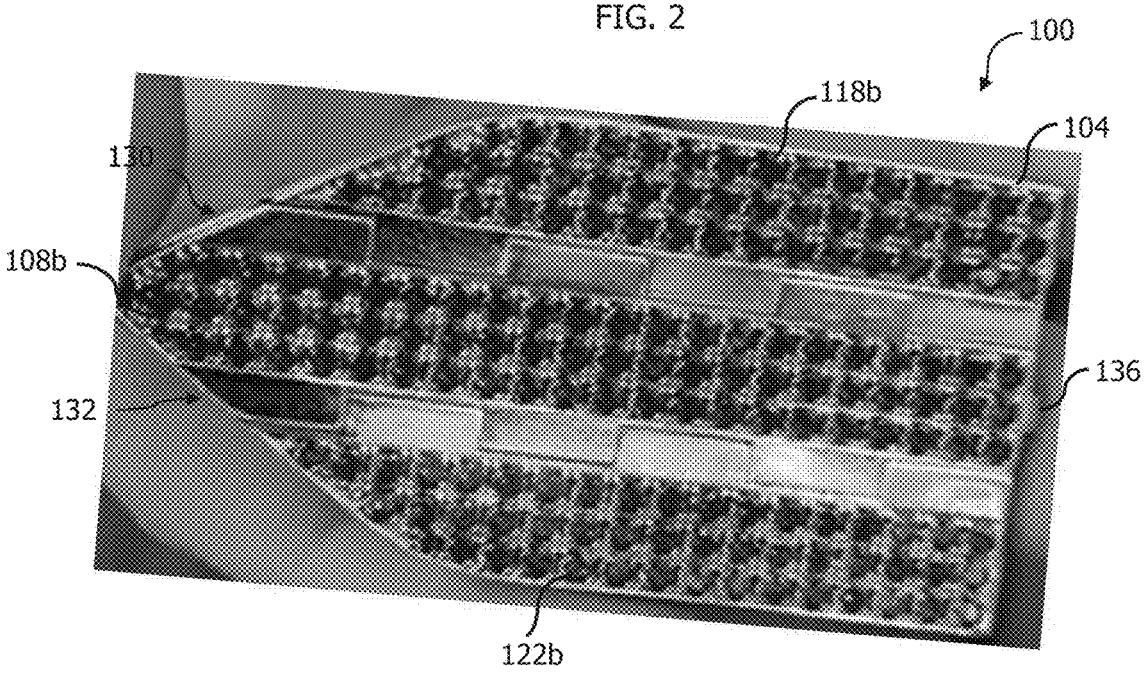
FIG. 2 is a photograph of an exterior, bottom plan view of an embodiment of a jewelry writing instrument, in its folded, closed position, with elongate rows of jewelry set stones therein.

Referring to the drawings in detail, and initially to FIGS. 1-7, a jewelry apparatus 100 according to a first embodiment has a front planar body 102 hingedly attached to a back planar body 104 by a transverse hinge 106 to fold the same into a flat closed position as shown in FIGS. 1 and 2. Both the front planar body 102 and the back planar body 104 have a central spine 108 that has spaced apart hinge knuckles 110 and 112 on opposing elongate sides 114, 116 thereof and a first leaf 118 (118*a* for the front planar body and 118*b* for the back planar body) with mating hinge knuckles 120 mated to hinge knuckles 110 of the central spine and a second leaf 122 (122*a* for the front planar body and 122*b* for the back planar body) with mating hinge knuckles 124 mated to hinge knuckles 112 of the central spine, thereby forming dual piano hinges.

The jewelry apparatus 100 has the naturally closed position of FIGS. 1 and 2. From this closed position, the front planar body 102 and the back planar body 104 are rotatable along the transverse hinge 106 to the open position of FIGS. 4-6 and then, the first and second leaves 118, 122 are foldable along the first hinge 126 and the second hinge 128, respectively, inward in a direct toward the central spine 108 into a writing position as shown in FIG. 7. The first and second leaves 118, 122 can be manually folded by the user into to writing position or can be automatically biased thereto by spring hinges. In the closed position, the jewelry apparatus 100 can approximately assume the size of a conventional credit card, business card or the like, and can be carried in a purse, wallet, pants pocket, shirt pocket, etc.

Figure 3:
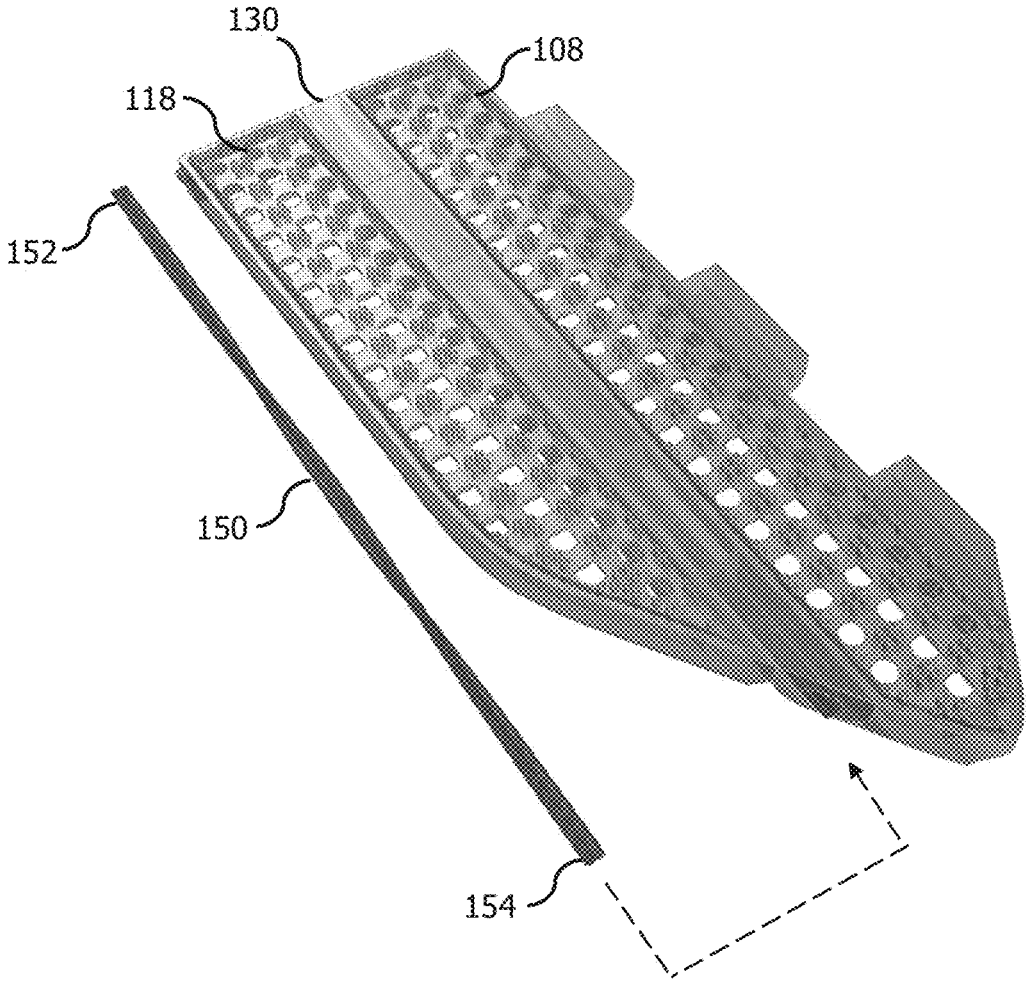
FIG. 3 is a perspective, exterior top view of one leaf of the panel connected to the central spine with the hinge spring pictured therebeside and with one in hinge.
Figure 4:
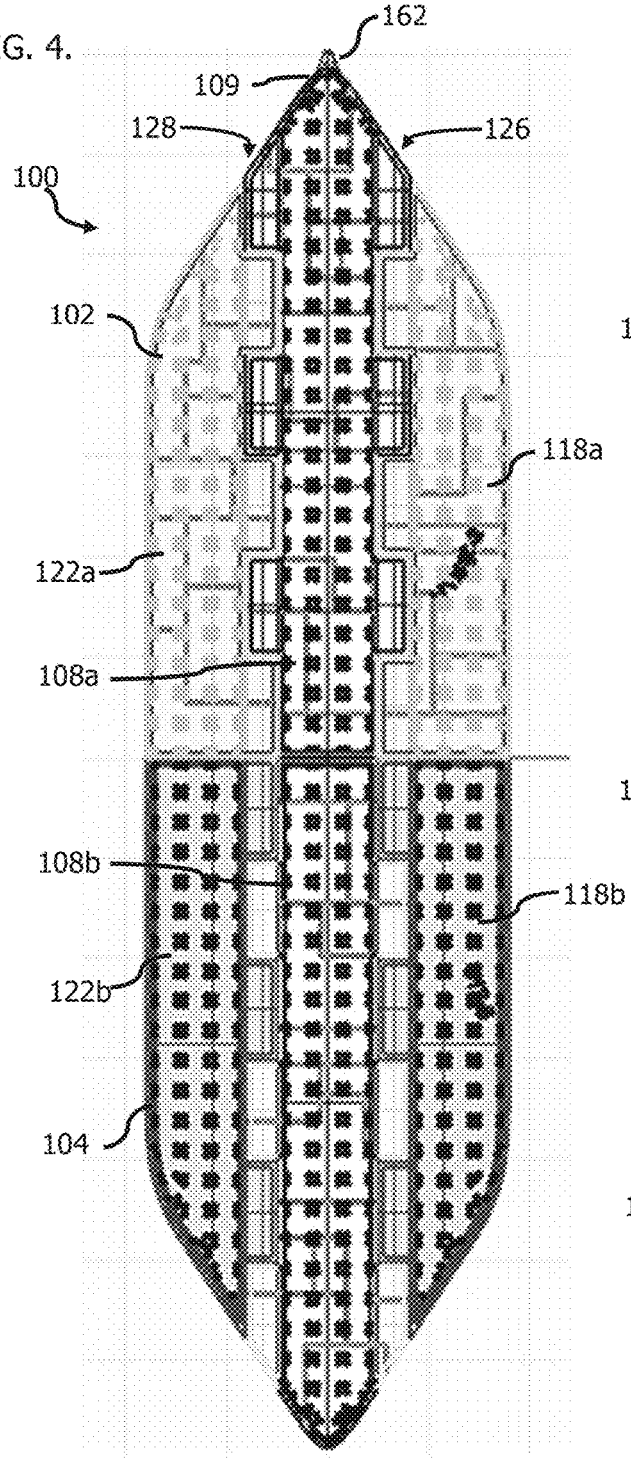
FIG. 4 is an exterior, plan view of the jewelry writing instrument in an open position.

Referring now to FIG. 3, optionally, the alternating knuckles 110, 120 and 112, 124 each define a hollow barrel having seated therein and affixed thereto a spring 150, thereby defining spring hinges. The spring hinges, when present, enable the first leaves and second leaves to be automatically biased together to fold into an elongate position with the interior surfaces thereof to the interior of the jewelry apparatus. The spring 150 is a flat spring, such as a steel spring or a stainless-steel spring. With the spring 150 seated in the hollow barrel of a respective hinge, a first end 152 of the spring 150 is permanently affixed to one end of the hinge, then with the front planar body 102 and the back planar body 104 rotated about the transverse hinge 106 into the open position, as shown in FIG. 4, the spring is wound (twisted) so that the respective first or second leaf folds into a writing position as shown in FIG. 7. Once wound, the second end 154 of the spring 150 is permanently affixed to the opposite end of the hinge. As, such, whenever the front and back planar bodies are opened to the open position, the first and second leaves of both bodies 102, 104 will automatically move or snap to the elongate position of FIG. 7.

With a spring fixedly attached as described in the preceding paragraph, the knuckles 110, 120 and a first flat spring define a first hinge 126 and the knuckles 112, 124 and a second flat spring define a second hinge 128. The first hinge 126 and the second hinge 128 are preferably piano hinges that are planar at least at the exterior surface of the front planar body 102. Respectively, the back planar body 104 includes mating knuckles and a flat spring in each set thereof to define a third hinge 130 and a fourth hinge 132. The third hinge 130 and the fourth hinge 132 are preferably piano hinges that are planar at least at the exterior surface the back planar body 104. These first, second, third, and fourth hinges are oriented perpendicular to the transverse hinge 106. In the figures, these hinges are shown as being defined by the joining of three knuckles from each piece, but the invention is not limited thereto. There can be five knuckles each, seven knuckles each, etc.

Figure 12:
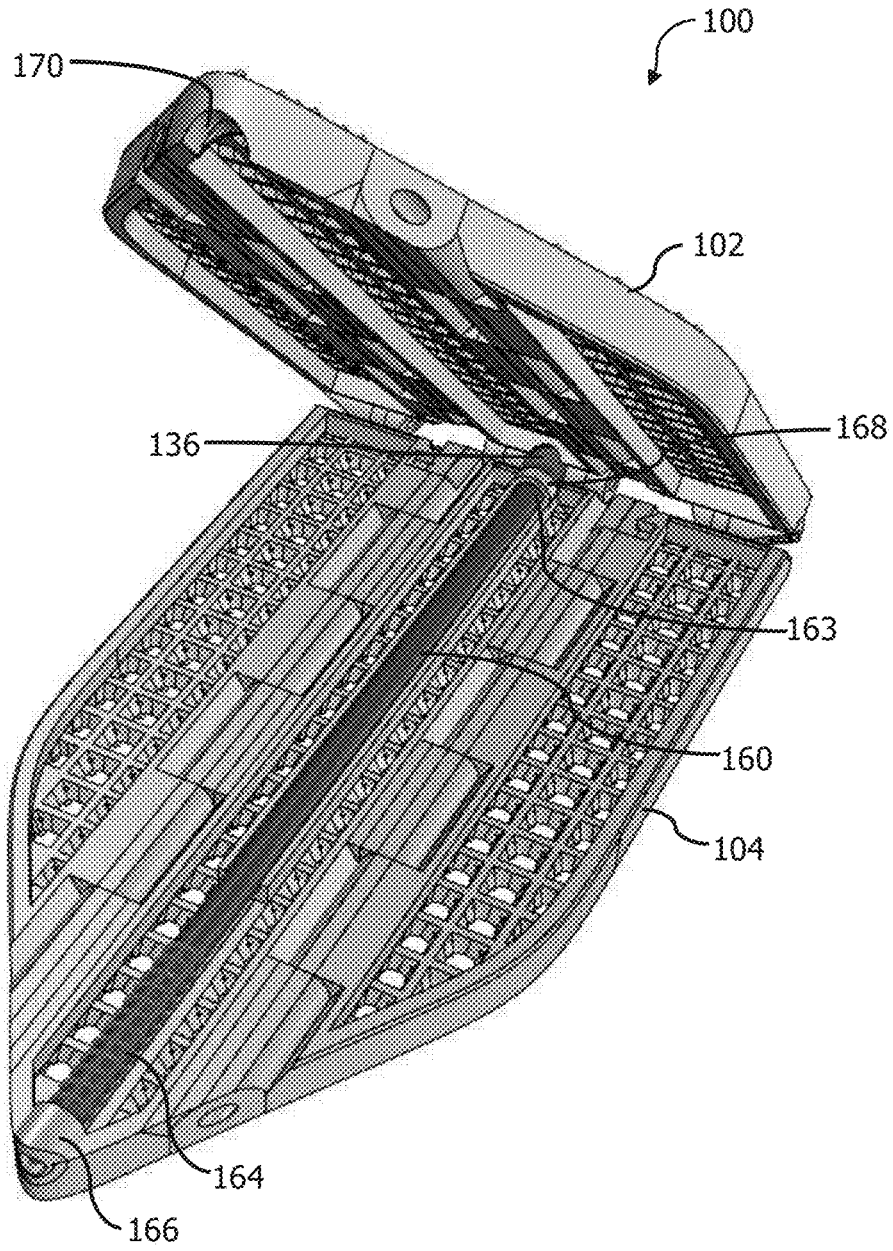
FIG. 12 is a side, perspective view of the first embodiment of the jewelry writing instrument in a partially open position to show the cam in operative engagement with an end of the writing instrument.

As best seen in FIG. 1, the transverse hinge 106 can be a more traditional cylindrical barrel hinge. The barrel hinge 106 can have spaced apart barrel-shaped knuckles 134 to define voids 140*a*, 140*b* between immediately neighboring knuckles. One of the barrel-shaped knuckles 134 includes a cam 136 incorporated in the transverse hinge 106 at a position in operative engagement with a writing instrument 160 (see FIGS. 5 and 6). Other knuckles can include a receptacle 142*a*, 142*b* for receiving a head that includes and attachment member (described below with respect to FIG. 9). The cam 136 is incorporated into the transverse hinge 106 to rotate when either the front planar body 102 or the back planar body 104 is rotated to the open position. When the cam 136 rotates it pushes the writing member 160 in a direction away from the transverse hinge 106, which compresses the activation spring 164 and pushes the tip 162 of the writing instrument 160 into a protruding position. Engagement of the cam 136 with a second end 163 of the retractable member 160 is shown in FIG. 12 and the protruding position is shown in FIGS. 4-7. The protruding position is where the tip 162 of the retractable member 160 protrudes beyond the end 109 of the flat folding writing instrument 100.

The cam 136 can be generally pear-shaped. "Generally pear-shaped" as used herein describes a frustum of a pear shape cut at two parallel planes through the length of the pear shape and parallel to the core of a pear (i.e., not transverse through the core). As such, the cam has a narrow end that is proximate the writing member 160 in the closed position, which is a retracted position for the tip 162 of the writing instrument. Then, when the cam turns as the flat folding writing instrument 100 is opened, the wider end of the cam engages the end 163 of the writing instrument 160 and pushes the tip outward into the protruding position.

Figure 5:
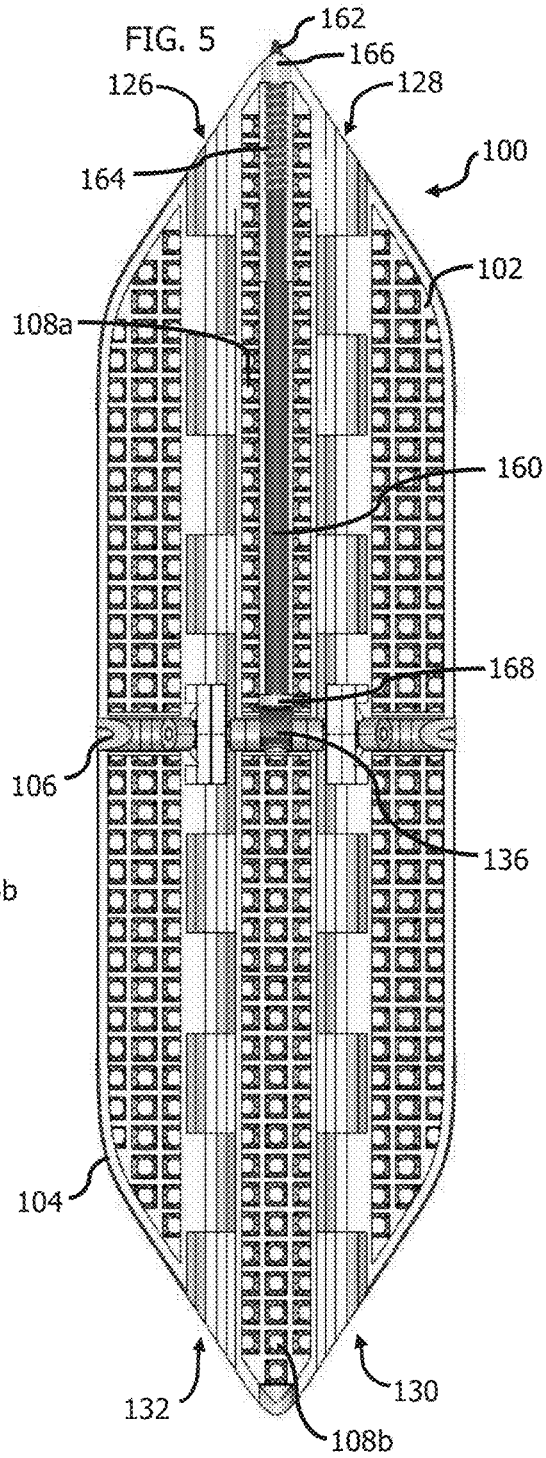
FIG. 5 is an interior, plan view of the jewelry writing instrument in an open position.
Figure 6:
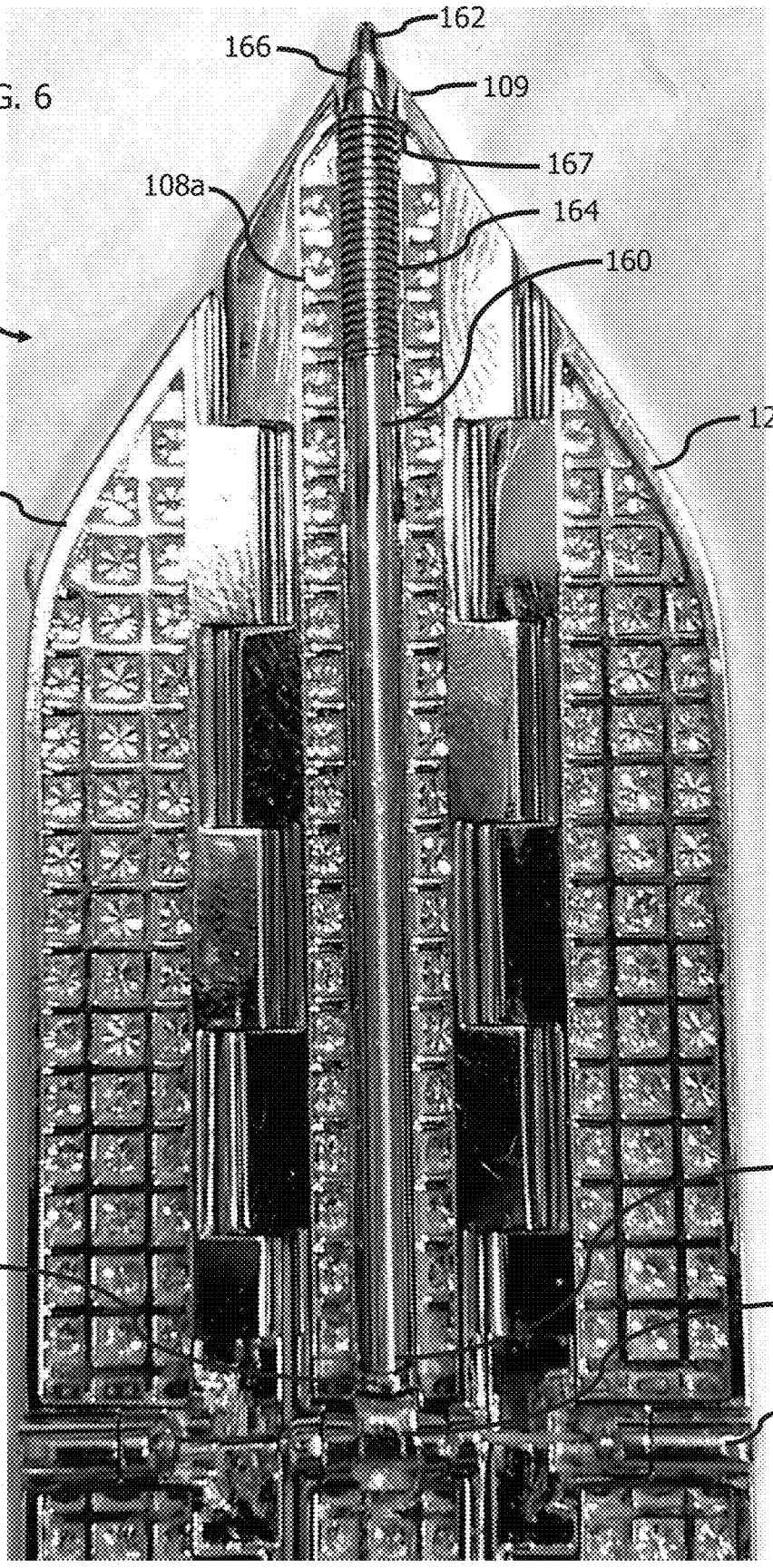
FIG. 6 is an enlarged view of the interior surface of the half of the jewelry writing instrument that holds the writing instrument.
Figure 7:
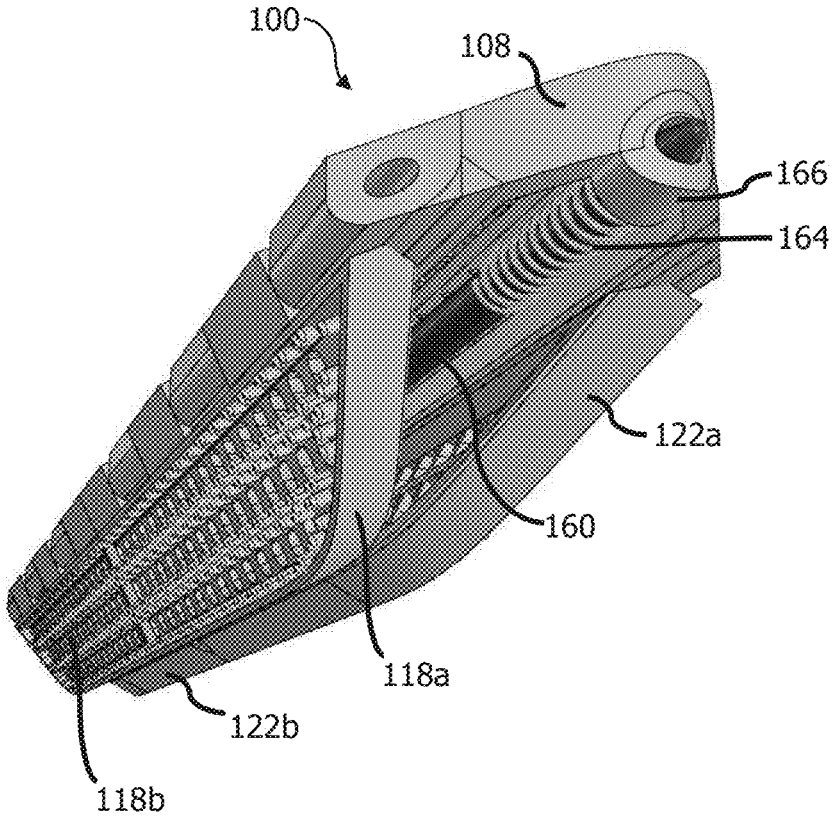
FIG. 7 is an end perspective view of the jewelry writing instrument folded elongately in the writing position.

Referring now to FIGS. 5 and 6, the retractable member 160, such as a writing instrument, in operative engagement with an activation spring 164 will be discussed in detail. The activation spring 164 can be a compression spring, such as a compression coil spring defining a hollow bore in which the writing instrument is received. The retractable member 160 is mounted to an interior surface of one of the front planar body 102 or the back planar body 104. The retractable member 160 can be permanently affixed thereto or removably, replaceably attached thereto, the latter being more preferred. When permanently affixed, any suitable means can be used. Some examples, include, adhesive, welding, soldering, etc. When removeably attached, the first or second planar body 102, 104 includes a first loop 166 defining a spring seat 167 or positioned proximate a spring seat 167 in which the tip 162 of the retractable member 160 is seated and has a second loop 168 positioned to receive the opposite end 163 of the writing instrument 160. The second loop 168 is positioned at a location suitable for inserting the tip 162 in the first loop with the activation spring 164 in compression, thereby enabling the opposite end 163 to be slid into the second loop 168 and movable between a retracted position (see FIG. 1) and a protruding position (see FIGS. 4-6) of the tip 162 without slipping out of the second loop 168. In this removably attachable embodiment, the retractable member 160 has the activation spring 164 fixedly attached thereto. The outer body or casing of the retractable member 160 is preferably metal or metal alloy for welding the activation spring thereto. Welding can include any know jewelry techniques including laser welding.

In FIGS. 1-9, the retractable member 160 is seated against the interior surface of the central spine 108 of one of the planar bodies 102, 104. The interior surface of the central spine 108 may include an elongate trough oriented perpendicular to the transverse hinge and shaped to receive the writing instrument 160 therein. Referring to FIG. 10, in another embodiment 100', the writing instrument 160 may be seated against the interior surface of one of the leaves 118, 122. The tip 162 of the writing instrument is visible in FIG. 10. In such an embodiment, the leaf that includes the writing instrument 160 should be at least the same length as the central spine and longer than or the same length as the other leaf. As best seen in FIG. 12, in the planar body opposite the first loop 166, a mirror image receptable 170 is defined in which the first loop 166 is receivable for the apparatus to be able to close. The mating of the receptable 170 and the first loop 166 can include a snap fit or interference fit to aid in maintaining the jewelry apparatus in the closed position. If there is not enough clearance for the second loop 168, there can be a second mirror image receptacle defined in the planar body opposite thereof in which the second loop is seated in the closed position.

As shown in the figures, the retractable member 160 can be a writing instrument, but is not limited thereto. When it is a writing instrument, the jewelry apparatus can be referred to as a jewelry writing instrument. The writing instrument can be an ink pen cartridge, such as those for a ball point pen, a roller ball pen, a felt tip cartridge, a mechanical pencil mechanism, a stylist for writing on surfaces of an electronic devices, an etching tool, or the like. In other nonlimiting embodiments, the retractable member 160 can be a toothpick, a laser pointer, a flashlight, tweezers, a wine corkscrew, or any other body suitable for use once activated by the cam 126 such that an end thereof protrudes beyond the end of the front or back planar body.

Figure 11:
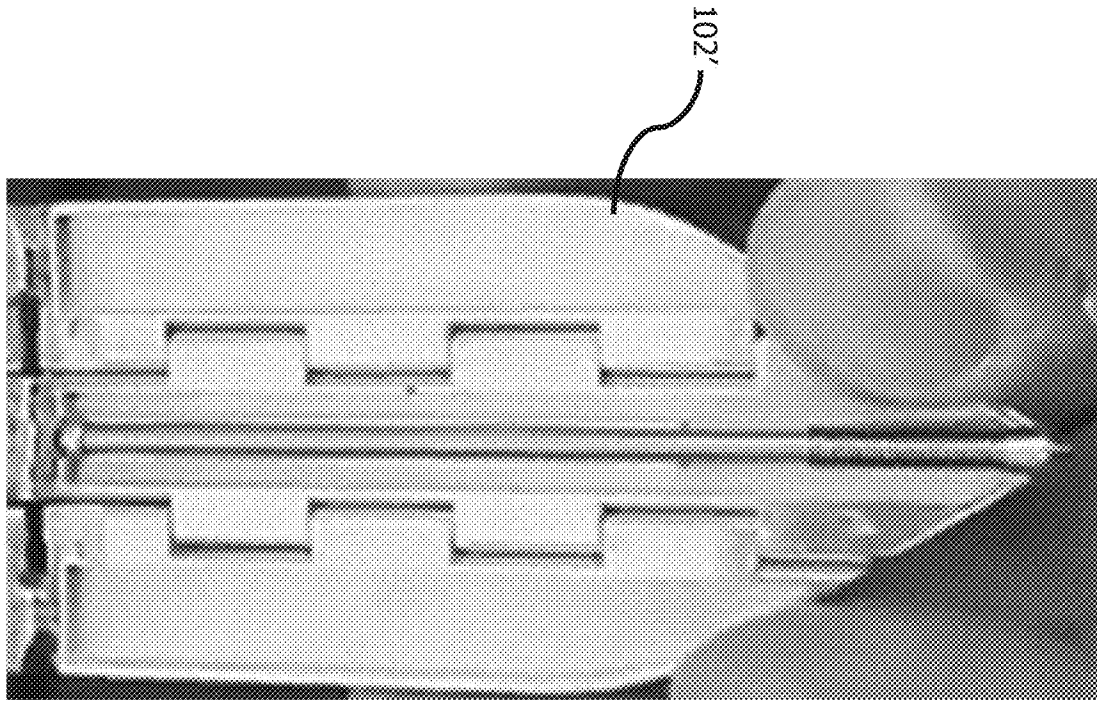
FIG. 11 is a photograph of an interior, plan view of another embodiment of the half of the jewelry writing instrument that holds the writing instrument.

Referring now to FIGS. 4 and 5, the transverse hinge 106 defines a line of symmetry for the perimeter shape of the flat folding writing instrument 100 in the open position. FIG. 4 is an exterior plan view and FIG. 5 is an interior plan view of the flat folding instrument 100. In FIGS. 4 and 5 both the front planar body 102 and the back planar body 104 have a plurality of jewelry sets defined therein. The jewelry sets can be arranged in myriad patterns. The plurality of jewelry sets can be arranged in a grid pattern defining elongate columns and short row in each of the central spine 108 and the first and second leaves 118, 122. In FIG. 11, the back planar body is solid, i.e., there are no jewelry sets present. In another embodiment, both the front and back planar bodies can be solid metals or metal alloys known to be used in jewelry making, and optionally embellished with other types of adornments, for example, an engraving, an etching, a painted surface, for example, an enamel paint that is annealed thereto, an inlay, for example a niello, a patina effect, hammering, embossing, punching, or other jewelry adornment techniques known or hereinafter developed.

When the flat writing instrument is intended to have one or more jewelry sets, the flat folding writing instrument is typically made of a material used for making jewelry. Suitable materials include metals and metal alloys that can include silver, gold, platinum, titanium, nickel, copper, iridium, nickel silver, palladium, and tungsten. The one or more jewelry sets each hold a synthetic gemstone or a natural gemstone. The natural gemstones are selected from the group consisting of alexandrite, amber, amethyst, ametrine, aquamarine, citrine, diamond, emerald, garnet, iolite, jade, kunzite, lapis lazuli, moonstone, morganite, opal, pearl, peridot, rose quartz, ruby, sapphire, spinel, sunstone, tanzanite, topaz, tourmaline, turquoise, zircon, and combinations thereof. The synthetic gemstones can be cut glass.

Figure 8:
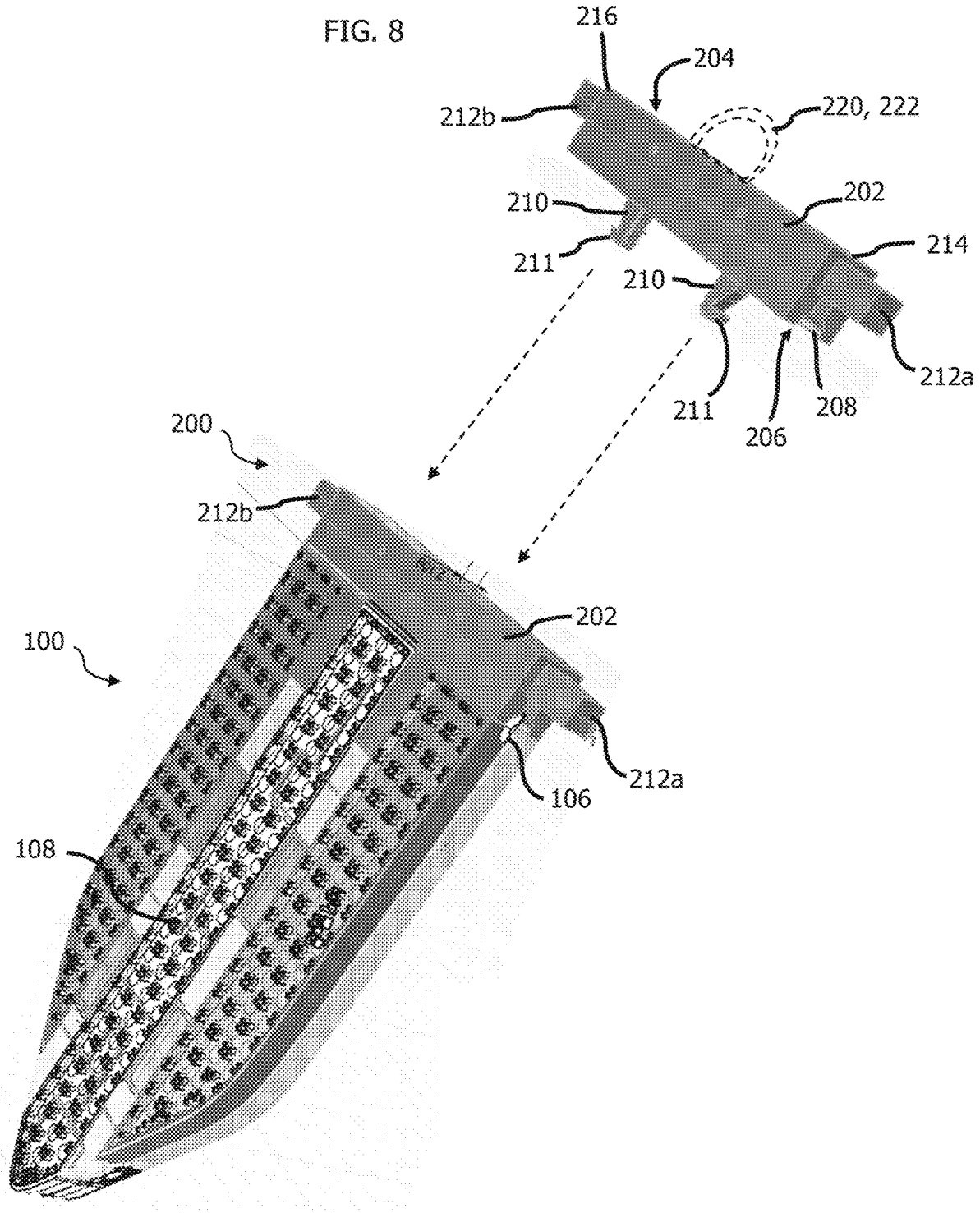
FIG. 8 is a front, side perspective view of an embodiment of a jewelry writing instrument, in the closed position, which includes an attachment member seated over and engaged to the transverse hinge.

Turning now to FIG. 8, the flat folding writing instrument 100 can include a head 200 removably attachable to the transverse hinge 106 thereof. The head 200 comprises an elongate housing 202 having a top surface 204 and an opposing bottom surface 206. The bottom surface 206 defines a trough 208 shaped to sit on the transverse hinge 106. Protruding from the elongate housing 202 through the trough 208 are a pair of hooks 210, each facing outward away from the central spine 108 of the flat folding writing instrument 100. The housing 202 encloses a first compression spring (not shown) having a first end in operative engagement with a first of the hooks 210 and a second compression spring (not shown) having a first end in operative engagement with a second of the hooks 210. The second end of each compression spring is in operative engagement with a push button 212. A first push button **212*a* extends from a first end 214 of the elongate housing and a second push button 212*b* extends from a second end 216 of the elongate housing. This is just one non-limiting example for the position of the push buttons. Here, the push buttons 212 extend beyond the width of the flat folding writing instrument, enabling a user to pinch the push buttons 212** toward one another using a thumb and finger to activate the hook mechanism.

The hook mechanism operably attaches the head 200 to the flat folding writing instrument 100 by seating each hook 210 in one of the voids **140*a*, 140*b* between knuckles 134 of the transvers hinge 106 (discussed above with respect to FIG. 1). To seat the hooks 210 in the voids 140*a*, 140*b* of the transverse hinge 106, a user pinches and holds the push buttons 212 in, thereby retracting the hook ends 211 of the hooks. Once seated in the voids 140*a*, 140*b* of the transverse hinge 106, the user releases the push buttons 212, which inserts the hook end 211 of each of the hooks 210 into a receptacle 142***a*, 142*b* in a respective hinge knuckle 134 (labeled in FIG. 1), thereby attaching the head to the flat folding writing instrument 100.

Figure 9:
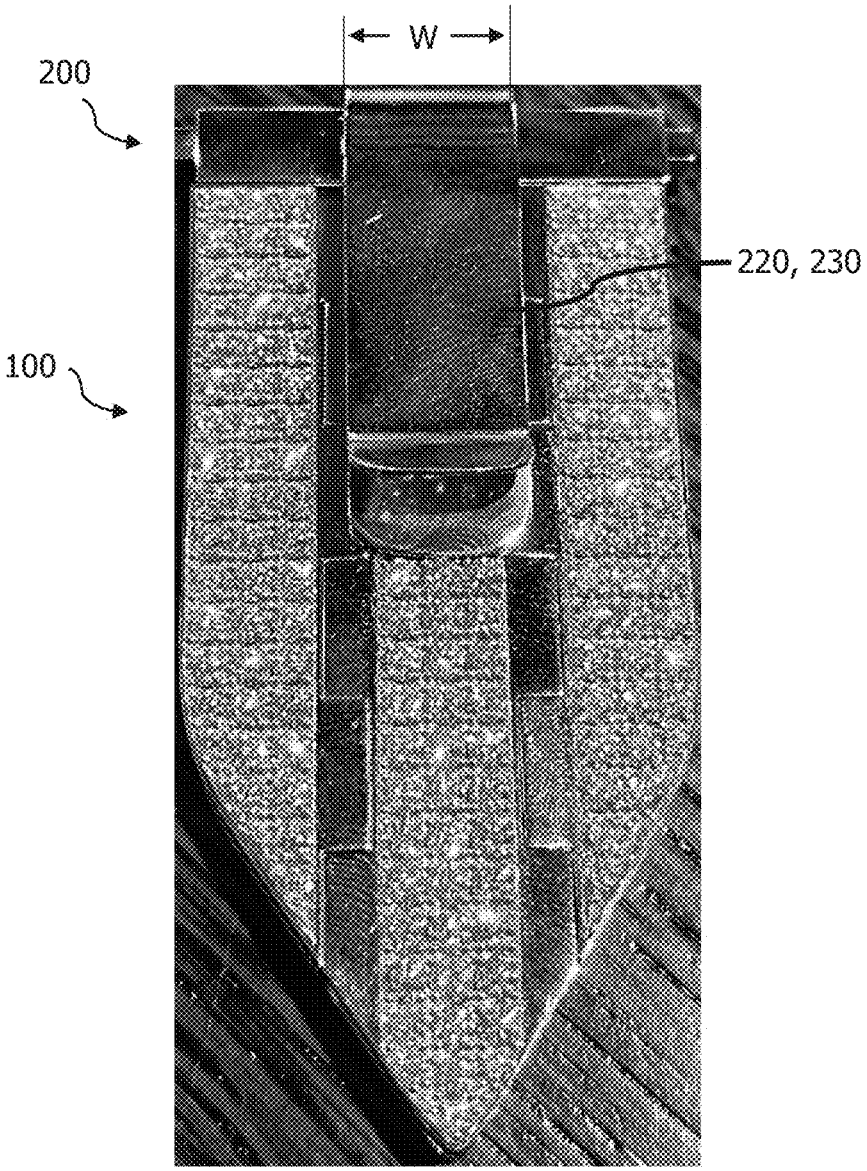
FIG. 9 is a photograph of an embodiment of the jewelry writing instrument having a money clip as part of the attachment member of FIG. 8.
Figure 10:
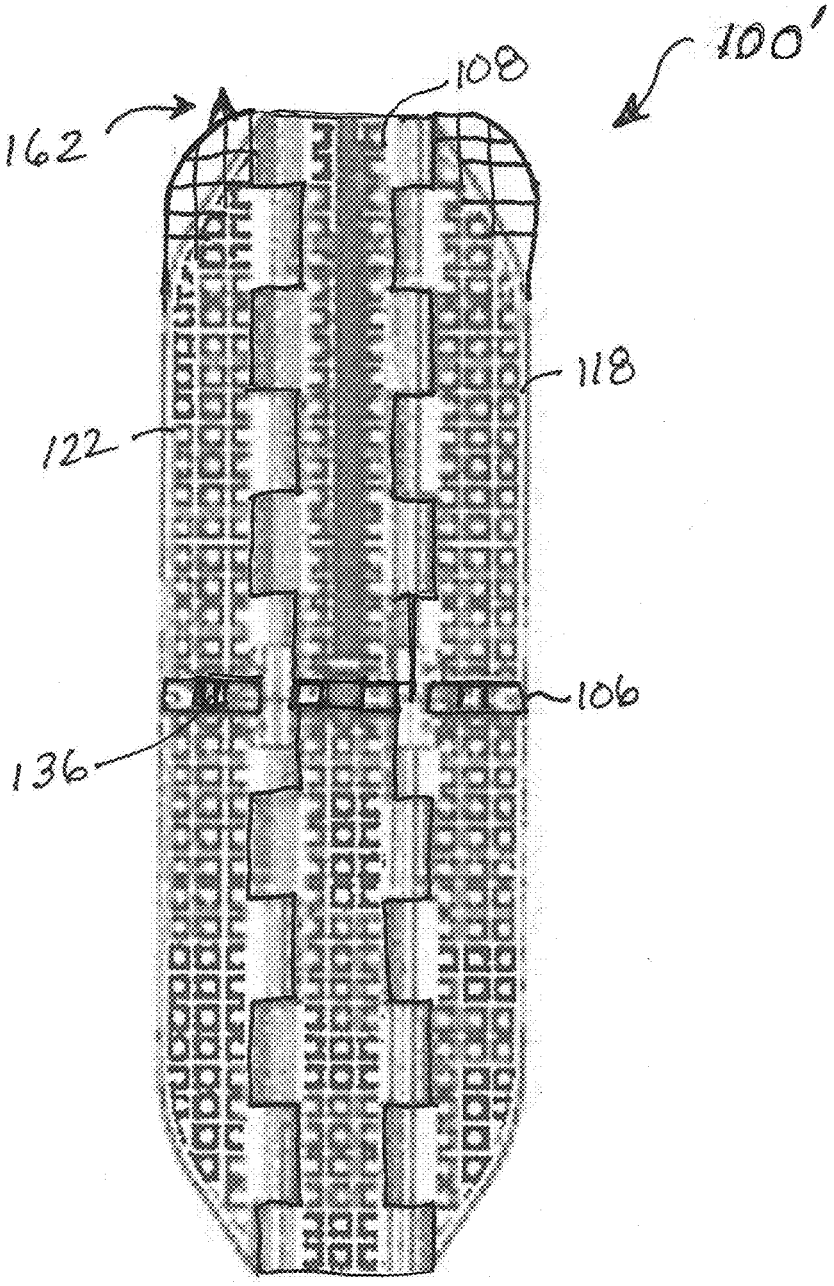
FIG. 10 is an exterior plan view of another embodiment of a jewelry writing instrument in the open position.

Referring to FIGS. 8 and 9, the head 200 can include an attachment member 220. In one embodiment, as shown in FIG. 8, the attachment member can be a ring 222, often referred to as a bail in jewelry terminology. A necklace chain, a key chain, a wrist chain, a strap, a ribbon, a cord, etc. can be threaded through the ring or attached to the ring. In another embodiment, as shown in FIG. 10, the attachment member can be a money clip 230. In yet another embodiment, rather than a money clip, the clip can be skinnier, i.e., have a smaller width (W) than the money clip, which renders it a pocket clip (one for attaching the flat folding writing instrument to the flap that defines a pocket, such as on a pair of jeans). In another embodiment, the attachment member can be a hook, such as a carabiner spring clip, a latching J hook. In still another embodiment, the attachment member can be a hang tag or open hook.

Having described specific preferred embodiments of the invention with reference to the accompanying drawings, it will be appreciated that the present invention is not limited to those precise embodiments, and that various changes and modifications can be affected therein by one of ordinary skill in the art within the scope and spirit of the claims.

What is claimed is:

1. A jewelry writing instrument comprising:

a front planar body and a back planar body hingedly attached to one another by a transverse hinge, wherein each of the front planar body and the back planar body comprise a central spine having a first leaf and a second leaf opposite thereto that are each hingedly attached to the central spine by a first hinge and a second hinge, respectively, that are oriented in a lengthwise direction that is perpendicular to the transverse hinge;

a writing member secured to one of the front planar body or the back planar body in operative engagement with a first spring; and a cam incorporated in the transverse hinge at a position in operative engagement with the writing instrument and incorporated to rotate when either the front planar body or the back planar body is rotated to an open position, thereby pushing the writing member into a protruding position;

wherein, from a closed position to an open position, the front planar body is foldable along the transverse hinge to an open position and then the first and second leaves are foldable along the first hinge and the second hinge, respectively, inward in a direct toward the central spine into a writing position.

2. The jewelry writing instrument according to claim 1, wherein the transverse hinge defines a line of symmetry for a perimeter shape of the flat folding writing instrument in the open position.

3. The jewelry writing instrument according to claim 1, wherein the writing member is an ink pen cartridge.

4. The jewelry writing instrument according to claim 1, wherein each of the first and second hinges of the front planar body comprise a plurality of alternating knuckles defining a hollow barrel having seated therein and affixed thereto a second spring that exerts a biasing force urging the first leaf and second leaf of the front planar body towards one another into the writing position.

5. The jewelry writing instrument according to claim 1, wherein either or both of the front planar body and the back planar body comprise one or more jewelry sets therein.

6. The jewelry writing instrument according to claim 5, wherein the one or more jewelry sets each hold a synthetic gemstone or a natural gemstone.

7. The jewelry writing instrument according to claim 6, wherein synthetic gemstones are cut glass.

8. The jewelry writing instrument according to claim 6, wherein the natural gemstones are selected from the group consisting of alexandrite, amber, amethyst, ametrine, aquamarine, citrine, diamond, emerald, garnet, iolite, jade, kunzite, lapis lazuli, moonstone, morganite, opal, pearl, peridot, rose quartz, ruby, sapphire, spinel, sunstone, tanzanite, topaz, tourmaline, turquoise, zircon, and combinations thereof.

9. The jewelry writing instrument according to claim 1, further comprising a head removably attached to the transverse hinge, wherein the head has an attachment member selected from the group consisting of a money clip, a bail, a pocket clip, a hang tag, a hook, and combinations thereof.

10. The jewelry writing instrument according to claim 1, wherein the head comprises a pair of opposing, user activatable, spring activated hooks that seat in receptacles in the transverse hinge.

11. A jewelry apparatus comprising:

a front planar body and a back planar body hingedly attached to one another by a transverse hinge, wherein each of the front planar body and the back planar body comprise a central spine having a first leaf and a second leaf opposite thereto that are each hingedly attached to the central spine by a first spring hinge and a second spring hinge, respectively, that are oriented in a lengthwise direction that is perpendicular to the transverse hinge;

a retractable member secured to one of the front planar body or the back planar body; and a cam incorporated in the transverse hinge at a position in operative engagement with the retractable member and incorporated to rotate when either the front planar body or the back planar body is rotated to an open position, thereby pushing the retractable member into a protruding position;

wherein each of the first spring hinge and the second spring hinge have a spring that automatically biases the respective first leaf and the second leaf of the respective front planar body and back planar body into an elongate position toward the central spine after the front planar body is folded along the transverse hinge to an open position.

12. The jewelry apparatus of claim 11, wherein the retractable member is a writing instrument.

13. The jewelry apparatus of claim 11, wherein each spring is a flat spring.

14. The jewelry apparatus of claim 13, wherein each of the first spring hinge and the second spring hinge is a piano hinge and each flat spring is fixedly connected to its respective piano hinge.

15. The jewelry apparatus of claim 11, wherein the transverse hinge defines a line of symmetry for the perimeter shape of the jewelry apparatus in the open position.

16. The jewelry apparatus of claim 11, further comprising an activation spring seated in operative engagement with the retractable member.

17. The jewelry apparatus according to claim 11, wherein either or both of the first planar body and the second planar body comprise one or more jewelry set gemstones therein.

* * * * *